United States Patent [19]

Matthews

[11] 4,190,009

[45] Feb. 26, 1980

[54] LINKING MACHINES

[75] Inventor: Denis Matthews, Sutton in Ashfield, England

[73] Assignee: Mathbirk Limited, Sutton in Ashfield, England

[21] Appl. No.: 914,233

[22] Filed: Jun. 8, 1978

[30] Foreign Application Priority Data

Jun. 15, 1977 [GB] United Kingdom ..... 24963/77

[51] Int. Cl.[2] ..... D05B 1/00; D05B 97/00

[52] U.S. Cl. ..... 112/262.1; 112/25; 112/163

[58] Field of Search ..... 112/25, 26, 27, 262, 112/163, 165, 197, 198

[56] References Cited

U.S. PATENT DOCUMENTS

| | | | |
|---|---|---|---|
| 1,476,658 | 12/1923 | Traver | 112/25 |
| 1,894,885 | 1/1933 | Parkin | 112/25 |
| 2,159,688 | 5/1939 | De Spain | 112/25 |
| 2,871,806 | 2/1959 | Bley | 112/25 |
| 2,969,757 | 1/1961 | De Spain | 112/25 |
| 3,119,360 | 1/1964 | Mayer | 112/25 |

*Primary Examiner*—Ronald Feldbaum
*Attorney, Agent, or Firm*—Frailey & Ratner

[57] ABSTRACT

A linking machine having a rotatable dial mounting a plurality of radially extending points on which two contiguous fabrics to be joined together are impaled. The sewing linking is provided with at least two needles, with one or more needles operating from opposite sides of the fabrics. One or more needles are located exteriorly of the dial, and each cooperates with a thread guide located interiorly of the dial to form a thread into a chain of stitches. One or more needles are located interiorly of the dial, and each cooperates with a thread guide located exteriorly of the dial to form a thread into a separate chain of stitches. In one form of the invention, the machine has a pair of reciprocal linking needles disposed on opposite sides of the fabrics to be joined, and each needle forms a simple single thread stitch chain. In another form of the invention, a pair of oversew needles also are provided, each of which enters the fabrics and withdraws, and then passes over the edges of the fabrics and withdraws, to form an oversew stitch to lock the free edges of the fabrics into the seam. In such an arrangement, a fabric cutter may be utilized to remove excess fabric after formation of the two single chain stitches and prior to the formation of the oversew stitch.

6 Claims, 2 Drawing Figures

LINKING MACHINES

This invention is for improvements in or relating to linking machines and has for one object to provide an improved machine for the joining together of two or more pieces of fabric as well as a stitch so formed by a linking machine, as well as a method for securing together two or more pieces of fabric.

In the specification of British patent No. 1016531, there is described a single needle linking machine.

In the specification of pending R. G. Birkhamchou U.S. application Ser. No. 803,518 filed June 6, 1977, there are described twin or multi-needle linking machines. In some instances twin linking needles operate side by side to form a seam, then a cutter removes surplus fabric, and then oversew needles operate to form an oversew stitch over the edge of the seam. In all instances of the twin linking needles, both needles operate either from the inside of the dial of a linking machine, with a thread guide provided on the exterior of the dial, or both needles operate from the exterior of the dial penetrating radially inwards to the fabric which has been impaled on the points of a linking machine, and with a thread guide provided interiorly of the dial to provide thread to each needle as it extends through the fabric to be joined. With a twin needle machine with both the linking needles operating from the same side of the fabric, used to form a single chain stitch, it will be appreciated that there is more build-up of thread one side of the fabric than on the other due to the very nature of a single stitch. In other words the formation of the chain stitch is not the same on both sides of the fabric, and when using a multi-needle machine, with all needles operating from the same side of the fabric, this build-up of thread on one side of the fabric as opposed to the other becomes more and more noticed.

According to the present invention, there is provided a sewing linking having two or more needles operating from opposite sides of the fabric to be joined to form a stitch or seam composed of two separate single thread chain stitches, one from each side of the fabric. The present invention also provides a linking machine substantially as described and illustrated herein with reference to the accompanying drawings. The present invention also provides for a stitch for joining together two or more pieces of fabric said stitch being formed from at least two different threads, each forming a single chain stitch provided by needles operating from opposite sides of the fabric.

In its simplest form the present invention provides a twin needle linking machine of the kind described in patent application Ser. No. 803,518 aforesaid with one of the linking needles operating from the exterior of the dial with a thread guide on the interior and the other linking needle operating from the interior of the dial with a thread guide to provide thread to the needle on the exterior thereof.

The two needles which operate from opposite sides of the fabric may be mounted on a common member which rocks or reciprocates about a pivot, so that as one needle moves in towards a fabric the other needle is withdrawing from the fabric.

Alternatively, the two needles may be mounted on a member which is secured to a slide so that the needles move or reciprocate in a straight line normal to the surface of the fabric upon penetrating withdrawing from the fabric. It will be appreciated that if the needles do move in a straight line on a slide, it is easier for a mechanic to set up the positioning of the needles than if the needles are pivoted about an arc. It is necessary for the needles accurately to be positioned relative to the points on which the fabric is impaled when entering the fabric to form the single chain stitch and withdrawing with the new loop.

The present invention also provides for a multi-needle sewing machine having four needles, two of which provide for two separate single thread chain stitches to be formed on the fabric, thereafter for a cutter to remove excess fabric and then for an oversew stitch to be provided on the outside of the seam to lock the cut edge of the fabric which has been removed into the seam, and with the two needles forming said oversew stitch operating from opposite sides of the fabric. In such an arrangement two needles will operate from one side of the fabric and the other two needles will operate from the other side of the fabric.

In order that the present invention may be more readily understood reference is now made to the accompanying drawings in which:

FIG. 1 is a cut away perspective view of a linking machine according to the present invention.

FIG. 2 is a part cross-sectional view of the machine illustrated in FIG. 1 from the same side. Referring to the figures a machine hood 1 houses an assembly of components for providing for the linking of fabric impaled on points 10 on a circular dial using a needle 9 operating from the inside of the dial and a needle 17 operating from the outside of the dial stitch, one being formed with the chain stitch from one side of the fabric and one on the other side of the fabric. The machine comprises a central pivot 6 which carries first arm 7 and second arm 8 on which the needle 9 is mounted on the inside of the dial, also pivoted on the pivot 6 is a third arm 15 mounting the needle 17. The arm 7 and 15 are rocked about the pivot 6 by a connecting link 5 secured to push rod 4 which is driven eccentrically so as to provide a rocking motion of the arms 15 and 7 about the pivot 6. Adjusting means are provided in the connection of the push rod 4 and link 5 so as to adjust the amount of reciprocal movement that the needles 9 and 17 have. The needles are conventional and are of the imperforate kind having a thread catching hook located rearwardly of the point. Examples of such imperforate, hooked needles are disclosed in U.S. Pat. Nos. 3,265,021, 3,476,064 and 3,922,982. When the needles enter into the fabric they are provided with thread on the far side of that from which they entered the fabric by a thread guide. Thread guide 12 is provided for the needle 9 and a thread guide 23 is provided for the needle 17. The thread guides are each mounted respectively on rotating bosses 13 and 18. The thread guides each have an eye at the end through which thread is threaded and the thread guides are rotated about the needles as the needles extend beyond the fabric in such manner that the thread is laid on the needle and caught in the hook. The needle then withdraws through the fabric drawing a loop of thread through the fabric and at the same time casting off the previously formed loop.

The thread guides are rotated respectively by a belt drive 26 for the thread guide 12 and belt drive 21 for the thread guide 23. The belts are driven from a common shaft 24 obtaining drive from another part of the machine.

In order to hold the fabric on the points as the needles enter the fabric and withdraw a first guard 11 is provided with apertures through which the needles 9 and 17 may extend and a second front guard 16. The first guard may be adjusted in slides 14 and the second guard is adjusted from a support 20. The position of the thread guide 12 may also be adjusted in a slide 2.

It will be appreciated that in use the thread is threaded through the eyes of the thread guides 12 and 23. When the machine is operating, first the needle 9 will enter the fabric and be wrapped with thread by the thread guide 12 and then as that needle withdraws through the fabric arm 15 will move the needle 17 to enter the fabric whereupon it will be wrapped with thread threaded on to the thread guide 23. Thus alternatively, a single chain stitch is formed first on one side of the fabric and then on the other side by the alternate action of the two needles 9 and 17. As a result, there is provided the same stitch formation on both sides of the fabric, thereby balancing stitch tension in the fabric.

It will also be appreciated that modifications to the construction herein described are possible as for example, by the provision of a pair of needles on the inside and a pair of needles on the outside. In such a construction a pair of reciprocal linking needles may be arranged to form two separate single thread chain stitches as herein before described in which the needles pass through the fabric only while another pair of needles operating from opposite sides are arranged to pass firstly through the fabric and then over the fabric to form an oversew stitch securing the selvedge edge of the pieces of fabric to be joined together. Between the forming of the two single chain stitches from opposite sides of the fabric and the forming of the oversew stitch, cutter means may be provided to remove excess fabric before the forming of the oversew stitch as described in patent application Ser. No. 803,518 aforesaid.

In an alternative construction not specifically described and illustrated herein, the needles 9 and 17 are mounted on a common member which is adapted to slide substantially horizontally relative to the surface of the points 10 and is reciprocated by an eccentric. The advantage of such a construction is that the needles 9 and 17 are moved parallel to each other and at right angles to the fabric to be joined together as opposed to moving in an arc. It will be appreciated that if the needles are reciprocated in an arc as described with reference to FIGS. 1 and 2 that it is necessary accurately to set the position of the needles relative to the points 10, whereas if they are reciprocated parallel to said points it is less difficult to adjust the position of said needles.

It is thought that by providing a twin or multi-needle linking machine, with the needles operating from opposite sides of the fabric, that a balanced stitch or seam is provided ensuring that exactly the same amount and quantity of yarn is provided in forming the stitch on each side of the two faces of the fabric to be joined.

What we claim is:

1. A linking machine having a plurality of radially extending points for impalement of two or more pieces of fabric to be joined together by a seam and a pair of reciprocal imperforate hooked needles, each needle being adapted to form a simple single thread chain stitch, wherein one needle is disposed on and operates from one side of fabrics impaled on the points and the other needle is disposed on and operates from the other side of the impaled fabrics, separate thread providing means for each needle, each said thread providing means being disposed on the side of the impaled fabrics opposite to the side on which its associated needle is disposed, said needles being operable to join the fabrics by a balanced seam which includes two separate single thread chain stitches.

2. A linking machine according to claim 1, further including reciprocal support means for mounting the needles in spaced relation to each other on opposite sides of the fabrics and actuating means to reciprocate the support means, whereby as one needle enters the fabrics the other needle withdraws from the fabrics.

3. A linking machine according to claim 2, wherein the reciprocal support means for the needles is mounted upon a pivot.

4. A linking machine according to claim 1, including at least two needles and having at least one needle disposed for operation on each side of the impaled fabrics to be joined together.

5. A method of joining together two or more pieces of fabric by a linking machine having a circle of radially extending points and at least two reciprocal imperforate hooked needles for forming simple chain stitches, comprising the steps of impaling the fabrics to be joined on a plurality of the points, actuating one of the needles from one side of the impaled fabrics and feeding thread thereto to form a first single thread chain stitch joining the fabrics, actuating a second needle from the other side of the impaled fabrics and feeding thread thereto to form a second single thread chain stitch joining the fabrics and alternately operating said two needles from said two opposite sides of the impaled fabrics to join the fabrics by a balanced seam which includes at least two separate single thread chain stitches.

6. A method according to claim 5, further including the steps of mounting the needles in spaced relation to each other on reciprocal support means and reciprocating said support means relative to the points whereby the needles are operated to continuously enter and withdraw from the fabrics, with one needle entering the fabrics while the other needle withdraws therefrom.

* * * * *

UNITED STATES PATENT AND TRADEMARK OFFICE

CERTIFICATE OF CORRECTION

PATENT NO. : 4,190,009

DATED : February 26, 1980

INVENTOR(S) : Denis Matthews

It is certified that error appears in the above-identified patent and that said Letters Patent are hereby corrected as shown below:

Abstract

Line 4, delete "sewing"; after "linking" insert --machine--

Specification

Column 1

Line 12, change "Birkhamchou" to --Birkhamshaw--

Line 13, after "U.S." insert --patent--

Line 32, after "single" insert --chain--

Figure 1:
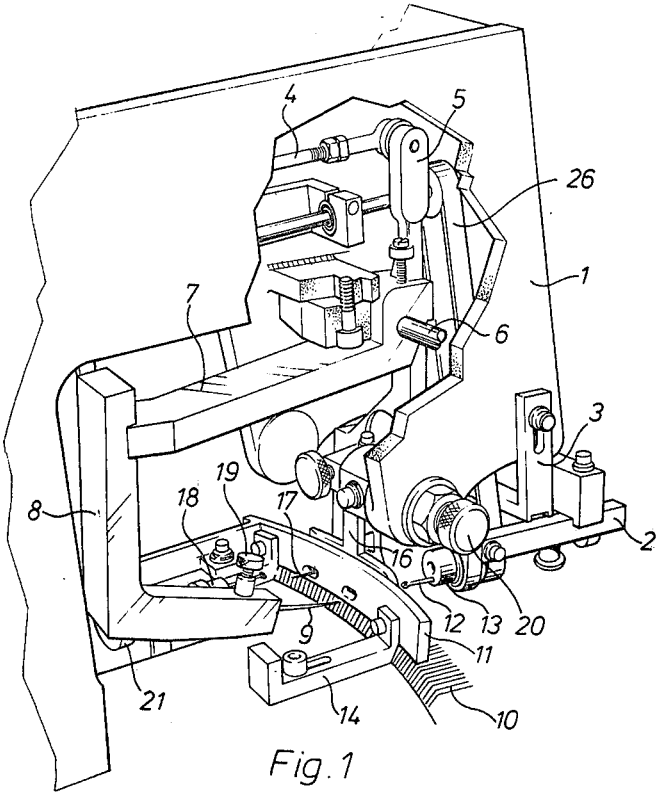
Figure 2:
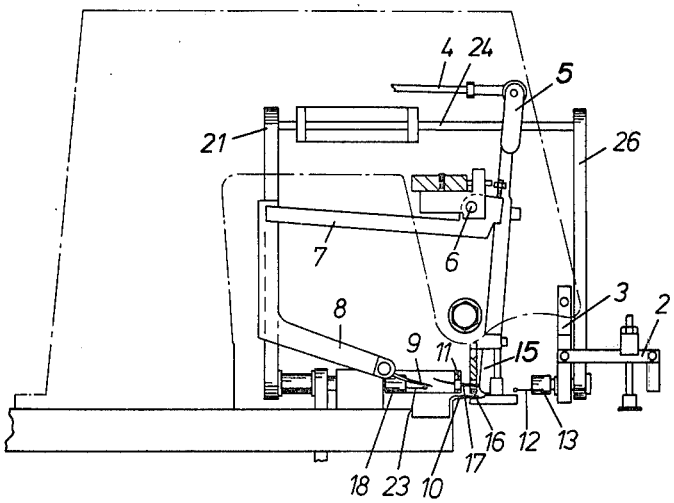

Line 39, delete "sewing"; after "linking" insert --machine--

Line 67, after "penetrating" insert --and--

UNITED STATES PATENT AND TRADEMARK OFFICE

CERTIFICATE OF CORRECTION

PATENT NO. : 4,190,009

DATED : February 26, 1980

INVENTOR(S) : Denis Matthews

It is certified that error appears in the above-identified patent and that said Letters Patent are hereby corrected as shown below:

Column 2

Line 31, after "dial" insert a period and then after the period insert --Each needle provides a simple single thread chain--

Signed and Sealed this

*Twentieth* Day of *May 1980*

[SEAL]

*Attest:*

SIDNEY A. DIAMOND

*Attesting Officer*

*Commissioner of Patents and Trademarks*